US009597542B2

(12) United States Patent
Marich et al.

(10) Patent No.: US 9,597,542 B2
(45) Date of Patent: Mar. 21, 2017

(54) EXERCISE DEVICE

(71) Applicants: Mitch Marich, Mequon, WI (US); Slobodan Kesic, Munster, IN (US); Michael Stojsavljevich, Crown Point, IN (US)

(72) Inventors: Mitch Marich, Mequon, WI (US); Slobodan Kesic, Munster, IN (US); Michael Stojsavljevich, Crown Point, IN (US)

(73) Assignee: Kettleball, LLC, Highland, IN (US)

( * ) Notice: Subject to any disclaimer, the term of this patent is extended or adjusted under 35 U.S.C. 154(b) by 61 days.

(21) Appl. No.: 14/222,081

(22) Filed: Mar. 21, 2014

(65) Prior Publication Data

US 2014/0287891 A1 Sep. 25, 2014

Related U.S. Application Data

(60) Provisional application No. 61/804,431, filed on Mar. 22, 2013.

(51) Int. Cl.

| | |
|---|---|
| ***A63B 21/072*** | (2006.01) |
| ***A63B 21/00*** | (2006.01) |
| ***A63B 21/06*** | (2006.01) |

(52) U.S. Cl.

CPC ..... *A63B 21/072* (2013.01); *A63B 21/4035* (2015.10); *A63B 21/0004* (2013.01); *A63B 21/06* (2013.01); *A63B 21/4033* (2015.10); *A63B 21/4043* (2015.10)

(58) Field of Classification Search

CPC ..... A63B 21/0004; A63B 21/00094; A63B 21/00101; A63B 21/00116; A63B 21/0013; A63B 21/06; A63B 21/0601; A63B 21/072; A63B 21/0724; A63B 21/0726; A63B 21/0728; A63B 21/075; A63B 21/1446; A63B 21/1465; A63B 21/1469; A63B 21/1484; A63B 2021/0722; A63B 23/12; A63B 23/1236; A63B 23/1263; A63B 21/00; A63B 21/0604; A63B 21/0608; A63B 21/4033; A63B 21/4035; A63B 21/4041; A63B 21/4043

USPC ..... D21/681, 682

See application file for complete search history.

(56) References Cited

U.S. PATENT DOCUMENTS

| | | | | |
|---|---|---|---|---|
| 1,927,492 | A * | 9/1933 | Halpin | A63B 47/00 206/315.9 |
| 7,731,640 | B1 * | 6/2010 | Chen | A63B 21/0728 482/108 |
| 7,883,452 | B1 * | 2/2011 | Chen | A63B 21/072 482/108 |
| 8,002,678 | B1 * | 8/2011 | Krull | A63B 21/0728 482/108 |
| 8,128,537 | B2 | 3/2012 | Signorile et al. | |
| 8,382,647 | B1 | 2/2013 | Hodes et al. | |
| 8,944,971 | B2 * | 2/2015 | Shorter | A63B 21/075 482/107 |
| 8,979,719 | B2 * | 3/2015 | Januszek | 482/108 |
| 2006/0199709 | A1 * | 9/2006 | Shepherd | A63B 21/072 482/109 |

(Continued)

*Primary Examiner* — Joshua Lee

(74) *Attorney, Agent, or Firm* — Greer, Burns & Crain, Ltd.

(57) ABSTRACT

An exercise device including a body and a handle extending from and offset from the body where the handle includes two different pairs of angled gripping portions.

8 Claims, 8 Drawing Sheets

(56) References Cited

U.S. PATENT DOCUMENTS

| | | | | |
|---|---|---|---|---|
| 2009/0093348 | A1* | 4/2009 | Wang | 482/93 |
| 2010/0248910 | A1* | 9/2010 | DiLuglio | 482/93 |
| 2010/0331151 | A1* | 12/2010 | Signorile | A63B 21/00196 482/93 |
| 2011/0275494 | A1* | 11/2011 | Radi | A63B 21/0602 482/93 |
| 2011/0306475 | A1* | 12/2011 | Caswell | A63B 21/0601 482/93 |
| 2012/0252641 | A1* | 10/2012 | Odneal | A63B 21/072 482/108 |
| 2013/0012367 | A1* | 1/2013 | Williams | 482/108 |
| 2014/0024506 | A1* | 1/2014 | Vixathep | 482/108 |

* cited by examiner

EXERCISE DEVICE

PRIORITY CLAIM

The present non-provisional application claims priority to and the benefit of U.S. Provisional Application No. 61/804,431 filed on Mar. 22, 2013, which is hereby incorporated by reference in its entirety.

BACKGROUND

The present invention relates generally to exercise equipment, and more particularly to weighted exercise bells used in weight training regimens.

Many people exercise to enhance or maintain their physical fitness and overall health and wellness. Other reasons to exercise include strengthening muscles and the cardiovascular system, improving athletic skills, weight loss or weight maintenance, as well as for enjoyment. Several different types of exercise machines, tools and devices have been developed to help people exercise and to strengthen and tone a particular part or parts of a person's body.

SUMMARY

The present invention relates to an exercise device, and more specifically, to an exercise bell fitness device-and a configuration of a handle on the exercise bell.

In an embodiment, an exercise device is provided and includes a body and a handle extending from and offset from the body where the handle includes two different pairs of angled gripping portions.

In another embodiment, an exercise device is provided and includes a body and a handle extending from the body. The handle includes a lower left-angled portion and a lower right-angled portion each attached to and extending from the body, an upper left-angled portion attached to and extending from the lower left-angled portion and an upper right-angled portion attached to and extending from the lower right-angled portion, and a lateral portion connected to and extending between the upper left-angled portion and the upper right-angled portion.

DETAILED DESCRIPTION

The present invention relates to an exercise device such as an exercise bell fitness device, and more particularly, to a configuration of a handle on the exercise bell.

Referring to FIGS. 1-6, an exercise device such as an exercise bell 10 according to an embodiment of the present invention is illustrated in which the exercise bell 10 is in an upright, resting position on a surface. The exercise bell 10 includes, among other things, a body 20 that acts as a weight and a handle 30. In this position, the handle 30 extends above the body 20 and extends over a side of the body 20. It should be appreciated that the body may be various different weights.

Figure 3:
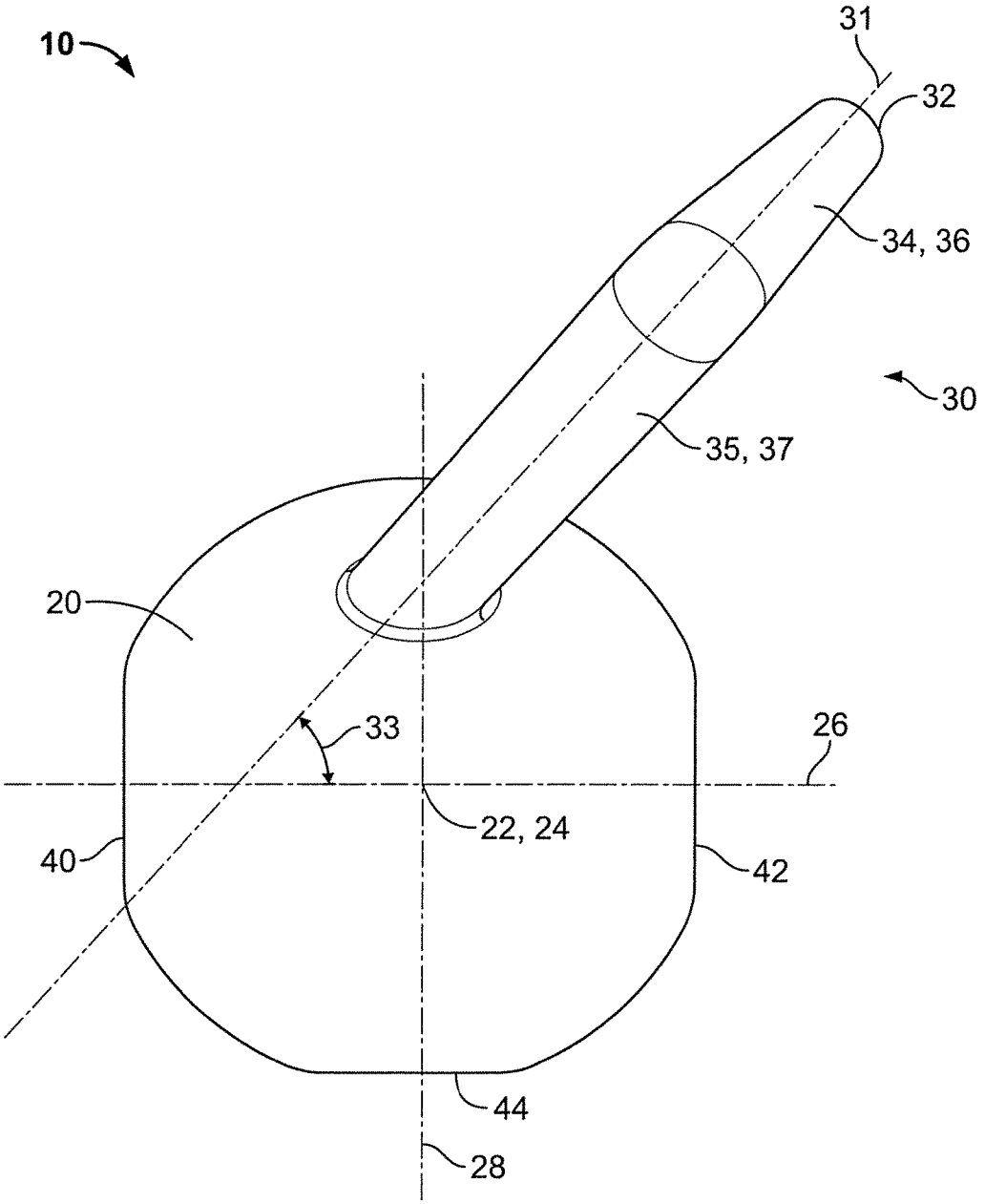
FIG. 3 is a side view of the exercise device of FIG. 1.
Figure 4:
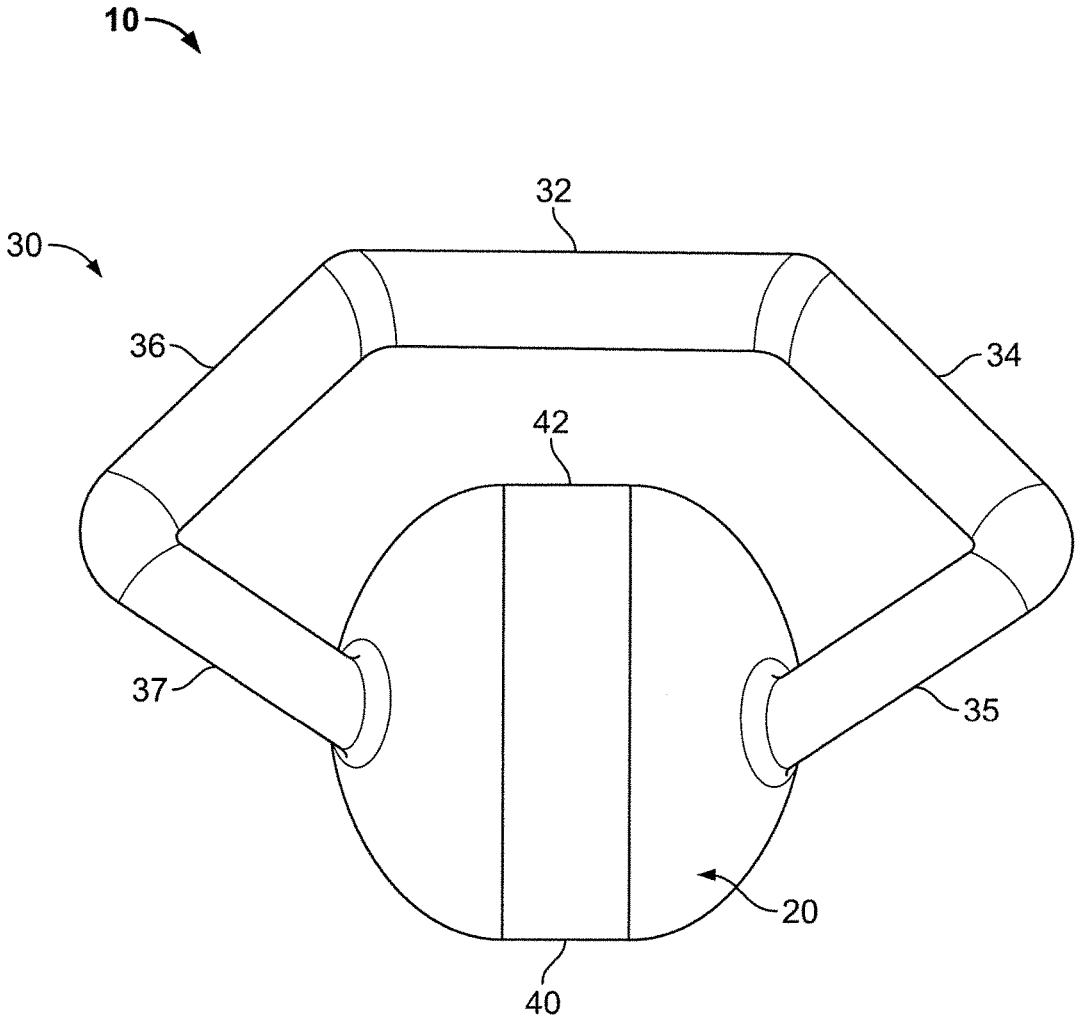
FIG. 4 is a top view of the exercise device of FIG. 1.
Figure 5:
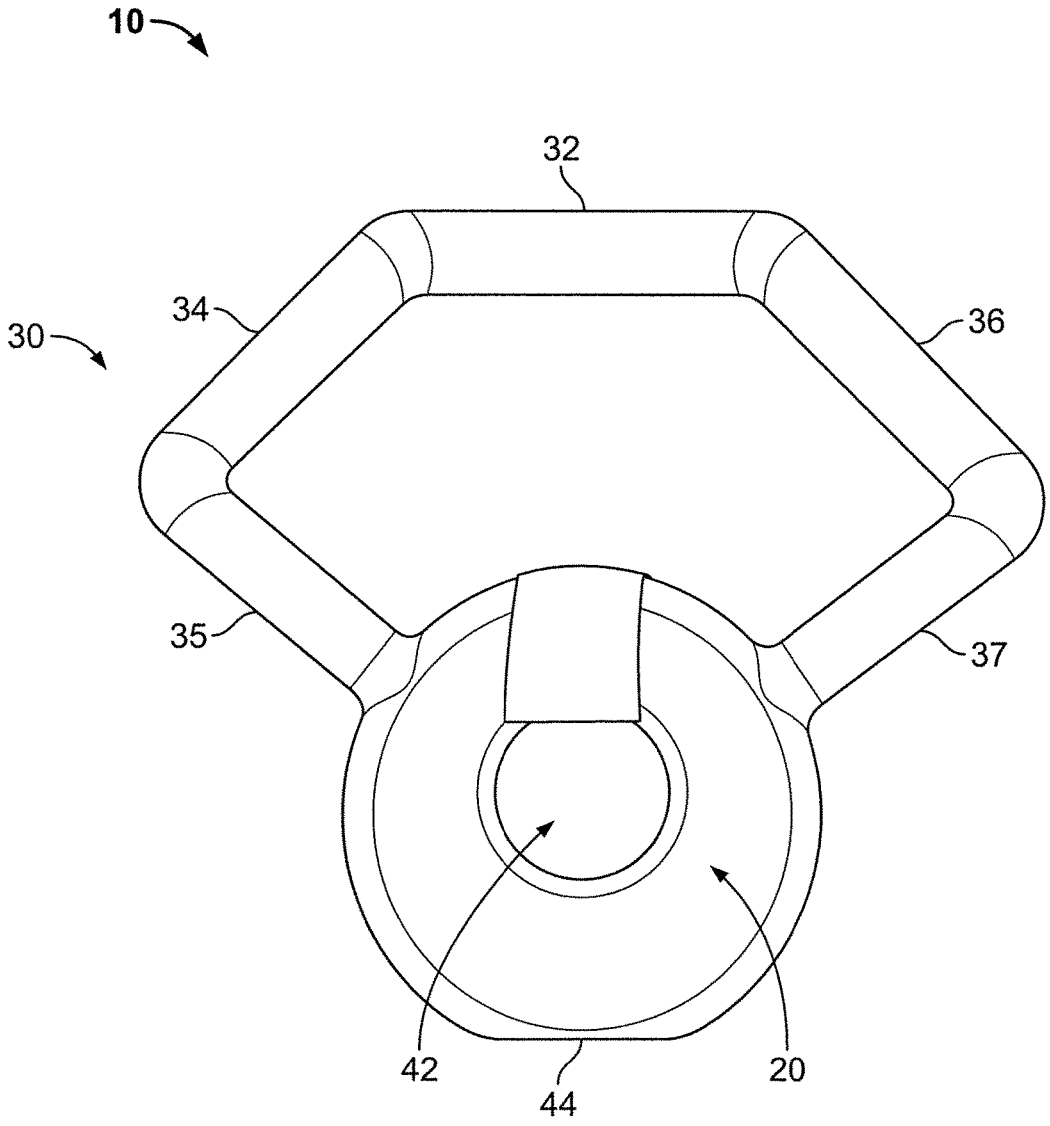
FIG. 5 is a rear view of the exercise device of FIG. 1.

FIG. 3 more clearly depicts the configuration of the handle 30 relative to the body 20, as the handle 30 is shown extending from the body 20 along a handle plane 31 to a point past the side of the body 20. It is conceivable that in other embodiments, portions of the handle 30 may not all extend along handle plane 31. This offset configuration for the handle 30 positions the body 20 further from a user during use of the exercise bell 10.

Figure 1:
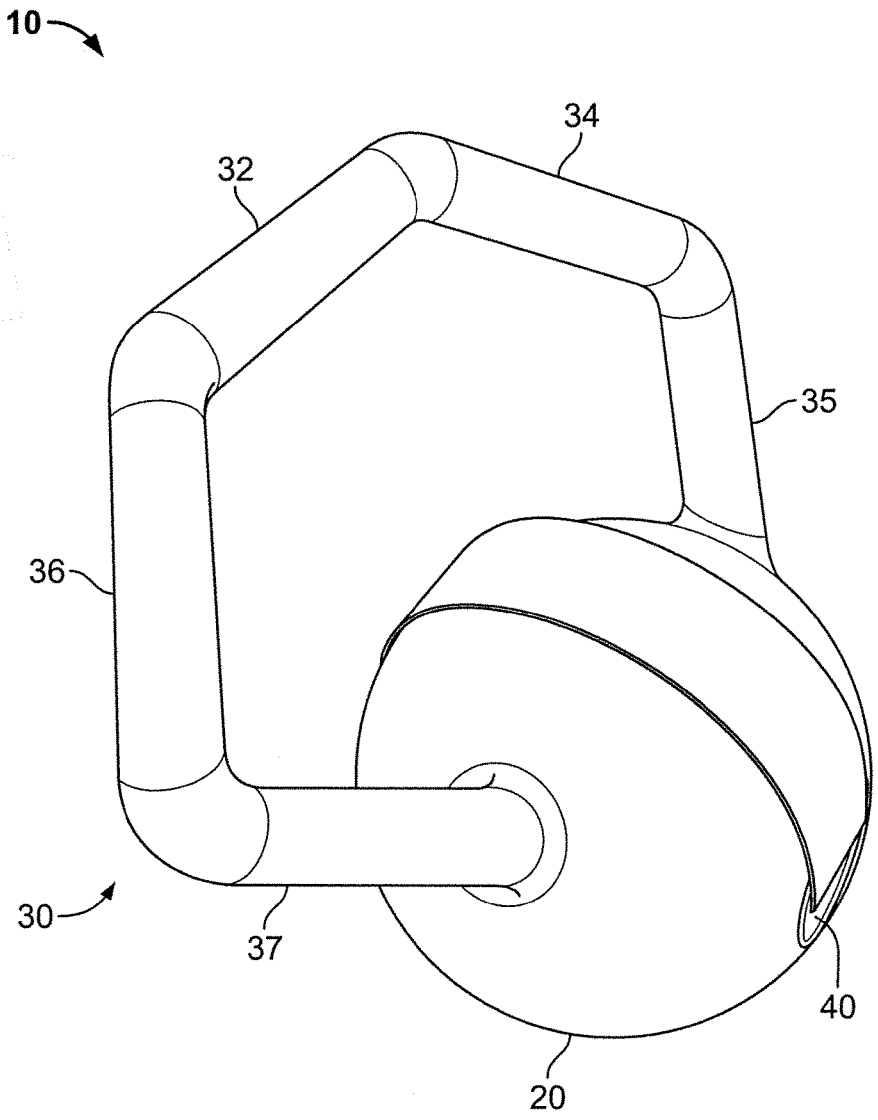
FIG. 1 is a perspective view of an embodiment of the present exercise device.
Figure 2:
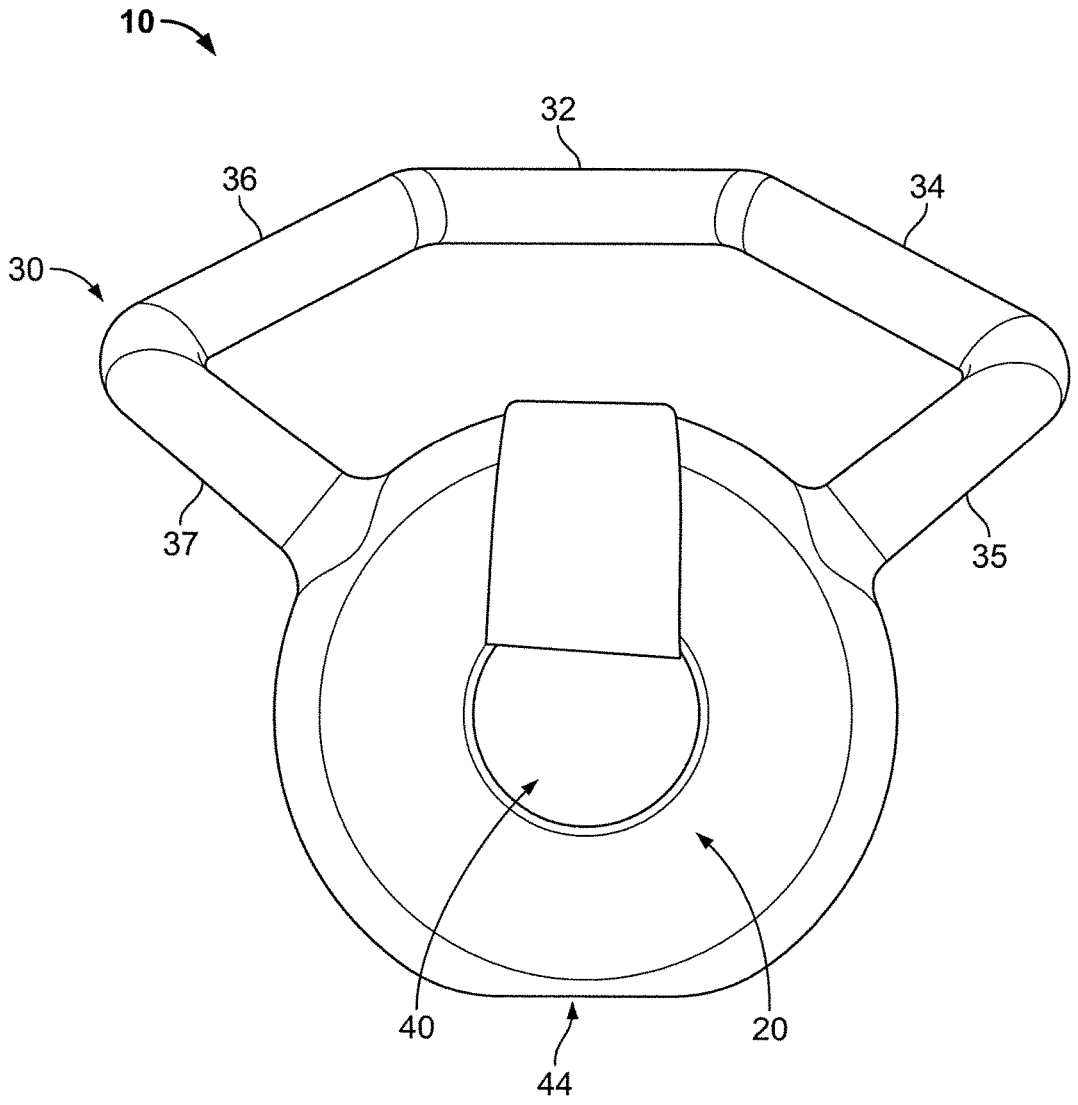
FIG. 2 is a front view of the exercise device of FIG. 1.

The body 20 is depicted as having a generally round shape, as shown in FIG. 1. The body 20 also includes, as shown best in FIG. 3, at least one flat surface and preferably, a front flat surface 40, a rear flat surface 42, and a bottom flat surface 44. These flat surfaces or flat areas allow the bell 10 to stably rest on the ground or other surfaces while not in use. The flat surfaces also provide space on the bell for indicia (not shown), which in the current embodiment, indicates the weight of the exercise bell 10, but may include other information. It is conceivable that the body can be shaped differently in other embodiments. For example, the body may have planar sides, making it box-like or prism-like, or other three-dimensional polygonal shapes, or may be a combination of planar surfaces and round surfaces. Further, the exercise bell can be configured in various sizes and weights to meet the fitness needs of the user.

In the illustrated embodiment, the body 20 is shown, as having a center of mass 22 and a dimensional center 24, as shown in FIG. 3. In this embodiment, the center of mass 22 and the dimensional center 24 are at the same point or at approximately the same point of the body 20. Other embodiments may have the center of mass and the dimensional center at different points depending on the shape of the body. FIG. 3 further shows a transverse plane 26 and a longitudinal plane 28 through the body 20. When the exercise bell 10 is at rest on a horizontal surface in an upright position as shown in FIG. 1, the transverse plane 26 is horizontal and the longitudinal plane 28 is vertical. The handle plane 31, as further shown in FIG. 3, is configured such that it extends from the body 20 at an oblique angle handle angle 33 as measured from the transverse plane 26. In this embodiment, the handle angle 33 is 44 degrees; however, it is conceivable that this angle can be configured at various other oblique angles. FIG. 3 also illustrates how the handle plane 31 extends above the center of mass 22 and the dimensional center 24 of the body 20 and does not pass through the center of mass 22 and the dimensional center 24 of the body 20. It is also shown in FIG. 3 that the handle 30 is attached to the bell body 20 at a non-centered point, preferably offset from at least one and preferably both the transverse plane 26 and the longitudinal plane 28.

Figure 6:
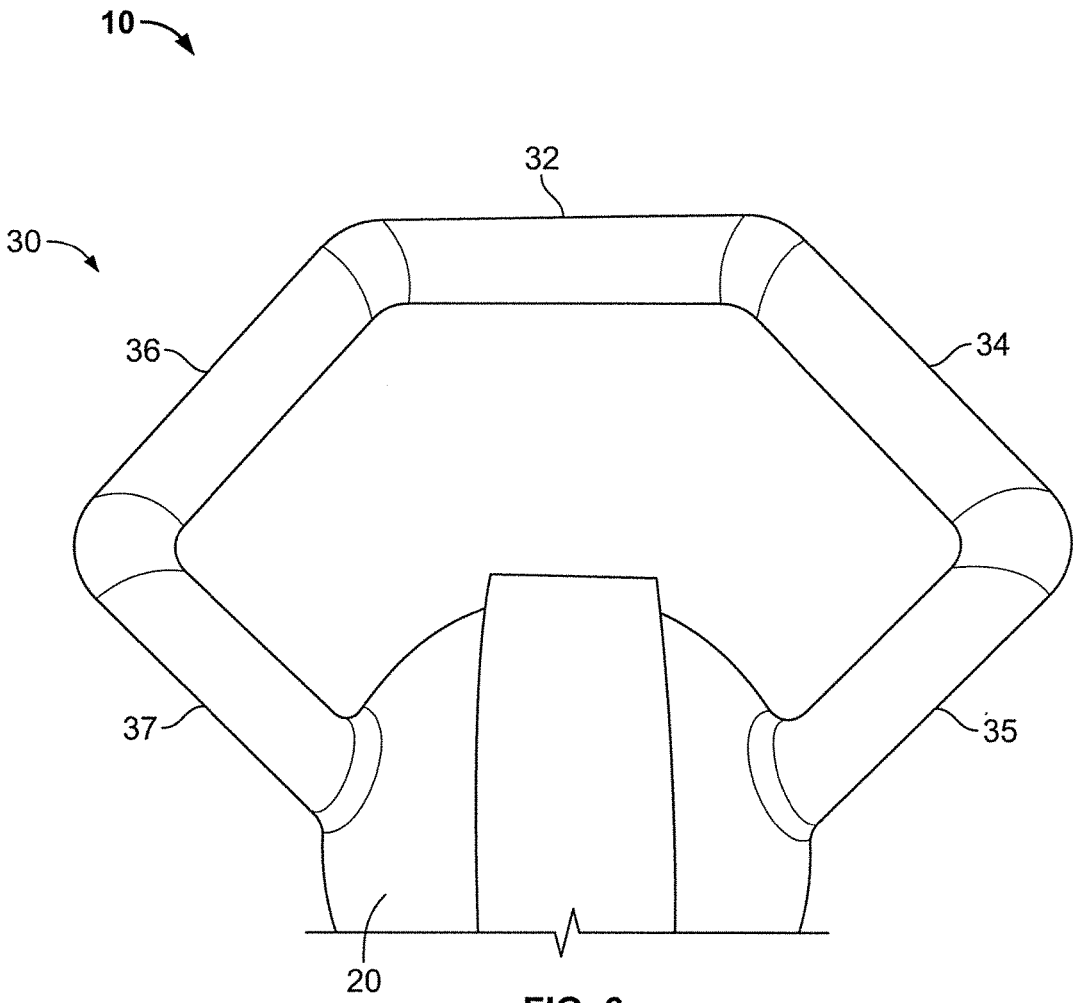
FIG. 6 is a fragmentary top perspective view of the exercise device of FIG. 1.
Figure 7A:
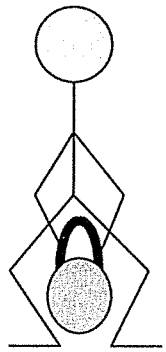
FIG. 7a PRIOR ART
FIGS. 7*a*-7*f* are schematic views of a person using a conventional exercise device.
Figure 7B:
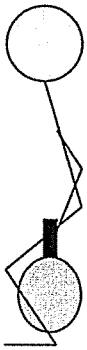
FIG. 7b PRIOR ART
Figure 7C:
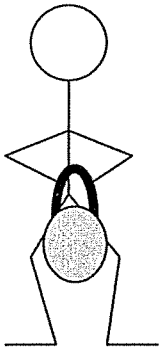
FIG. 7c PRIOR ART
Figure 7D:
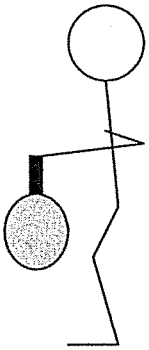
FIG. 7d PRIOR ART
Figure 7E:
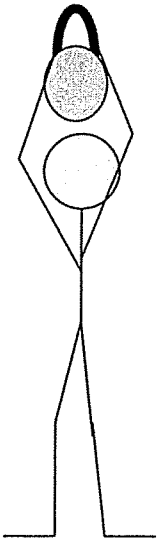
FIG. 7e PRIOR ART
Figure 7F:
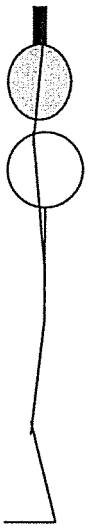
FIG. 7f PRIOR ART
Figure 8A:
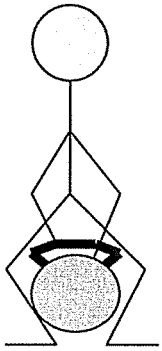
FIGS. 8*a*-8*f* are schematic views of a person using the exercise device of FIG. 1.
Figure 8B:
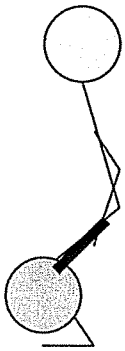
Figure 8C:
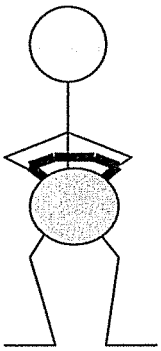
Figure 8D:
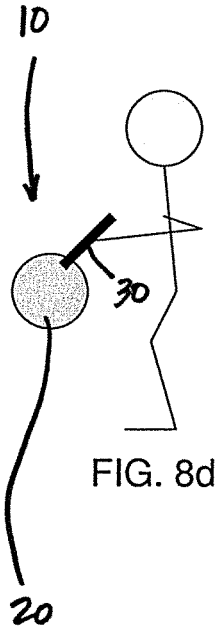
Figure 8E:
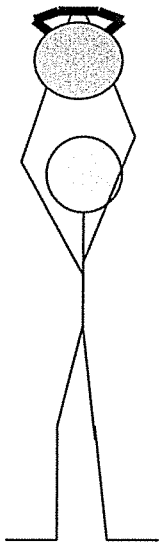
Figure 8F:
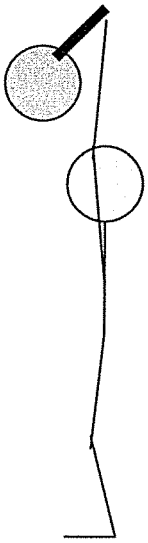

As shown in FIG. 1, the handle 30 is preferably generally circular in transverse cross-section, however other irregular, ergonomically designed cross-sectional shapes that facilitate gripping are contemplated, including but not limited to configurations with partially circular and partially flat-sided regions when viewed in cross-section. The handle 30 further includes a lateral portion 32, an upper right-angled portion 34, a lower right-angled portion 35, an upper left-angled portion 36, and a lower left-angled portion 37, all of which are disposed along the handle plane 31, as shown in FIG. 3. FIG. 6 further shows that the lower right-angled portion 35 and the lower left-angled portion 37 extend upward and outward away from each other and from the body 20 on opposite sides of the body until they intersect with the upper right-angled portion 34 and the upper left-angled portion 36, respectfully, at a point about half way along the handle plane 31 from the body 20 to the lateral portion 32 at the distal ends of the upper right-angled portion 34 and the upper left-angled portion 36, as best shown in FIGS. 3 and 6. As shown in FIG. 6, the upper right-angled portion 34 and the upper left-angled portion 36 extend upward and inward from the respective intersections with the lower right-angled portion 35 and the lower left-angled portion 37 until the upper right-angled portion 34 and the upper left-angled portion 36 intersect with opposite ends of the lateral portion 32. The lateral portion 32 resides in a plane that is perpendicular to the longitudinal plane 28. These handle portions provide various positions and angles for a user to grasp and use the handle 30. For example, for a standard bicep curling exercise, a user can comfortably grasp the lower portions 35 and 37 with his hands which are angled outwardly so that a user can keep his elbows further out from his body than his hands during curling. Likewise, for triceps extensions, a user can comfortably grasp the upper portions 34 and 36 again to keep his elbows further out from his body than his hands while pushing the body outward from his body. The offset handle configuration, as described above, further allows a user to lift the exercise bell 10 with and the body 20, protecting the user's arm from the body 20.

In the preferred embodiment, the exercise bell 10 is a cast iron material and cast in one piece, namely, the body 20 and the handle 30 are integrally formed as a single piece. It is conceivable that one in the art could also choose other materials, such as other types of metals, composites of metals and other materials, such as polymers, or other composite materials. Further, it is conceivable that the exercise bell 10 is constructed from multiple pieces, instead of cast as one piece. For example, the body 20 and the handle 30 may be separate pieces that are then joined by joining operations, such as the various types of welding or mechanically joined by fasteners, such as, but not restricted to nuts and bolts, or chemical adhesives. Also, the handle 30 itself may be made from a single piece that is bent into form or from multiple pieces that are fastened together by commonly known methods, some of which were described above.

The exercise bell 10 is configured in the preferred embodiment such that a user can use the exercise bell 10 in body positions and with motions that provide physical, ergonomic, and mental benefits to the user.

Referring to FIGS. 7*a*-7*f*, a conventional kettlebell exercise is illustrated with a conventional kettlebell exercise device or kettlebell, the body of the kettlebell remains directly under the user's hands during an exercise. In one such exercise, a user swings the kettlebell with two hands from a position where the body of the kettlebell and the hands of the user are between the user's knees to a position where the body of the kettlebell and the hands of the user are over the head of the user. In doing this exercise, the user must take care not to swing the kettlebell too far to prevent falling backwards, such as might happen if the typical kettlebell is swung to a point beyond the point directly above the user's head.

Referring now to FIGS. 8*a*-8*f*, an exercise using the exercise bell 10 is illustrated where the exercise bell 10 includes handle 30 positioned in relation to the body 20, as depicted in FIG. 3 and described above. The user uses the present invention such that the body 20 of the exercise bell 10 is positioned in front of the user's hands during exercises. In this way, a user to swings the exercise bell 10 in front of his body with confidence that the user will not swing the body 20 past his head.

In an embodiment, an outer coating is applied to the exercise bell 10, which in this embodiment is paint. The exercise bell 10 may also have other coatings, such as rubber, plastic, other polymers or composites, or other coatings that are commonly known for covering and protecting metals. Only portions of the exercise bell 10 may have such coatings or the entire exercise bell 10 may have such coatings or different coating can be applied to different parts of the exercise bell 10. For example, the body 20 may have one coating and the handle 30 may have a different type of coating. Also, different types of exercise bells may have different coatings or different color coatings to indicate information to a user, such as different sizes or weights of the exercise bells may have different colors. Further, the exercise bell 10 may have no coatings at all.

While a particular embodiment of an exercise device has been described herein, it will be appreciated by those skilled in the art that changes and modifications may be made thereto without departing from the invention in its broader aspects and as set forth in the following claims.

What is claimed is:

1. A kettlebell exercise device comprising:

a body including a flat bottom surface and a center of mass, and a vertically oriented longitudinal plane extending through a center of said body, wherein when said flat bottom surface of said body is on an underlying surface, said longitudinal plane is transverse to the underlying surface; and a handle connected to said body at a handle connection location and defining a plane, said handle extending at a designated angle from said longitudinal plane of said body such that said plane of said handle extends through said handle connection location but not through said center of mass and said flat bottom surface, said handle including:

a lower left-angled portion and a lower right-angled portion each attached to and extending from said body, an upper left-angled portion attached to and extending from said lower left-angled portion and an upper right-angled portion attached to and extending from said lower right-angled portion, and a lateral portion connected to and extending between said upper left-angled portion and said upper right-angled portion.

2. The exercise device of claim 1, wherein said handle is offset from said body.

3. The exercise device of claim 1, wherein said designated angle is 44 degrees.

4. The exercise device of claim 1, wherein said body includes at least one additional flat surface.

5. The exercise device of claim 1, wherein said body has a center of mass at a first point and a dimensional center at a second point, said first point and said second point being the same point.

6. The exercise device of claim 1, wherein said body has a center of mass at a first point and a dimensional center at a second point, said first point and said second point being different points.

7. The exercise device of claim 1, wherein said body has a center of mass at a first point and a dimensional center at a second point, and said plane of said handle does not intersect said first point and said second point.

8. The exercise device of claim 1, wherein said body and said handle are integrally formed with each other.

* * * * *